US006019872A

United States Patent [19]

Kurrle

[11] Patent Number: 6,019,872

[45] Date of Patent: Feb. 1, 2000

[54] AUTHENTICATABLE BLEACHED CHEMICAL PAPER PRODUCTS

[75] Inventor: Frederick L. Kurrle, Laurel, Md.

[73] Assignee: Westvaco Corporation, New York, N.Y.

[21] Appl. No.: 09/233,438

[22] Filed: Jan. 20, 1999

[51] Int. Cl.[7] ..... D21F 11/00; G07D 7/00; D21H 21/40

[52] U.S. Cl. ..... 162/140; 162/141; 162/142; 162/149; 162/198; 73/53.03; 283/70; 283/72

[58] Field of Search ..... 162/140, 165, 162/198, 141, 149, 142, 26, 25, 91, 28; 283/70, 74, 72, 79, 67; 73/53.03

[56] References Cited

U.S. PATENT DOCUMENTS

| | | | |
|---|---|---|---|
| 38,835 | 6/1863 | Olier | 162/140 |
| 491,858 | 2/1893 | Schlumberger | 162/140 |
| 1,938,543 | 12/1933 | Sanburn | 162/140 |
| 2,173,167 | 9/1939 | Hovey | 162/142 |
| 2,208,653 | 7/1940 | Whitehead | 162/140 |
| 2,379,443 | 7/1945 | Kantrowitz et al. | 162/140 |
| 2,598,580 | 5/1952 | McEwen et al. | 162/142 X |
| 3,829,357 | 8/1974 | Thompson et al. | 162/26 X |

OTHER PUBLICATIONS

Brandis, "Evaluation opf spot tests for detecting lignin," Abbey Newsl. 17 No. 1: pp. 11–12, Paperchem Abstract, May 1993.

*Primary Examiner*—Stanley S. Silverman
*Assistant Examiner*—José A. Fortuna

[57] ABSTRACT

An authenticable paper product is prepared from a bleached chemical papermaking furnish containing a minor but detectable amount of lignin containing fibers selected from the group consisting of mechanical, thermomechanical, chemi-thermomechanical and bleached-chemi-thermomechanical.

3 Claims, No Drawings

AUTHENTICATABLE BLEACHED CHEMICAL PAPER PRODUCTS

BACKGROUND OF INVENTION

The present invention relates generally to the production of authenticatable paper. More specifically, the present invention relates to a process for producing authenticatable chemical bleached paper and paperboard products by introducing into the papermaking furnish lignin containing fibers in an amount sufficient to be detectable with the use of a phloroglucinol staining technique. It is unlikely that the use of such fibers in bleached paper would be apparent as an authenticatable feature.

Traditionally, counterfeiting has been associated with the illicit production of currency. Today, however, there is a significant loss to manufacturers of goods by counterfeiting. This type of counterfeiting costs companies millions of dollars of lost revenue. For example, cigarette, pharmaceutical, computer software and related companies have experienced problems with counterfeited goods being sold worldwide. Furthermore, these counterfeited goods are usually made cheaply thereby causing an unsuspecting consumer to question the manufacturers' quality.

Thus it would be desirable, and in the best interest of a manufacturer to eliminate to the extent possible the sale of counterfeited goods from an economic and public perception point of view. One way to accomplish this result is to provide packaging, labels and the like that can be authenticated for packaging the legitimate goods of a manufacturer.

Paper manufacturers have several different options at their disposal to authenticate their paper products. These include the use of watermarks, specialized printing, holographic labels, and the use of synthetic or fluorescent fibers or additives. Thus the paper used for packaging goods which does not include one of the these identifying features may be presumed to package counterfeited goods.

Watermarks consist of impressing a design into the wet fiber web prior to couching the paper. Since this process is done early in the papermaking process, it arranges some of the fibers within the paper. This arranging of the fibers makes watermarks difficult to duplicate.

Watermarks are used extensively in European and U.S. currencies and security documents. The security of the watermarking process may be enhanced with the controlled deposition of fibers during the paper forming process and the placing of individual, unique watermarks on each piece of paper.

The use of watermarks is ideally suited to the manufacture of thin papers such as currencies, bank checks, etc., which are substantially translucent. However, the use of watermarks on heavy weight paper or paperboard normally used for packaging is of less utility because of the low transmission of light through such products. A watermark on these thicker papers would not be readily apparent as in thinner, more translucent papers.

Complicated printing techniques have also been used as security devices for currencies. These are typically lifelike portraits and intricate designs. Additionally, specialty inks, blended exclusively for these end uses, have extensive use in the security document sector. These specialty inks include everything from using multiple colors, to the use of high intensity ultraviolet light to create a pattern fluorescing in visible or ultraviolet light. However, the advent of high quality, color photocopiers has made the use of special inks and intricate designs less of a barrier to the counterfeiter.

In response to the increased ingenuity of counterfeiters, microprinting was developed. Microprinting is a technique where messages, etc., are finely printed on a paper substrate. To the naked eye, the printing appears to be a single line, but under magnification, the messages may be revealed. This technique makes duplication of the paper substrate more troublesome because the printing technique is difficult to reproduce. However, a drawback to the microprinting technique is that it is relatively easy to acquire a printing press. Also, one can set up this printing equipment anywhere and keep it well hidden.

Holographic labels are also used as an anti-counterfeit device. These labels have an image impressed into them which changes appearance dependant on the point of view. A familiar example of these labels is the shiny image on credit cards. While these are effective as an anti-counterfeit device, they are expensive to produce and keep track of.

Placing dyed synthetic fibers into the paper substrate has been practiced for many years as an anti-counterfeit device. A common example is the paper used for U.S. currency which has blue and red synthetic fibers in it. Though effective, it has a significant drawback because it can only be used in specific applications.

Finally, it is also known to use fibers, pigments and the like in the structure of the paper products that can be identified using various techniques. For example, U.S. Pat. No. 1,938,543 teaches that detectable fibers which have been specially treated with a chemically sensitive substance can be incorporated into paper and, upon contacting such paper with a second chemical agent, the detectable fibers change color and become distinguishable. As illustrated in U.S. Pat. No. 2,208,653, authenticatable paper can also be made by including fibers of an organic ester of cellulose that have been treated with a tertiary amine. The treated fibers are invisible in the paper and become fluorescent under ultraviolet light. U.S. Pat. No. 2,379,443 discloses authenticatable paper made by the addition of a small percentage of cellulosic fibers that have been treated with hydrated ferric chloride which has been hydrolyzed to iron hydroxide. The treated fibers are capable of acquiring a deep blue color upon application to the paper of a potassium ferrocyanide solution, followed by an orthophosphoric acid solution.

Nevertheless, the authenticatable papers disclosed in the prior art generally have not proven entirely satisfactory because, for example, of their complexity of manufacture, or the fact that such papers before authentication often visibly differ from paper that does not include an authenticatable feature, or the procedure for testing is cumbersome.

It is apparent from the above that there exists a need in the art for an authenticatable paper or paperboard that is inexpensive to manufacture, effective in use, and hard to duplicate. Furthermore, the authenticable materials used should not interfere with the print characteristics of the paper nor the coating operations. It is the purpose of this invention to fulfill these and other needs in the art in a manner more apparent to the skilled artisan once given the following disclosure.

SUMMARY OF INVENTION

In accordance with the present invention, chemical bleached paper and paperboard products may be made authenticatable by the addition of a small percentage of lignin containing fibers to the papermaking furnish. Such fibers when incorporated in a paper or paperboard substrate at a concentration of between about 0.5–5.0 lbs/ton may be detected using a phloroglucinol staining technique. In particular, the preferred lignin containing fibers of the present invention are those that are typically used in papermaking for other purposes and to make products other than bleached products, e.g., newsprint. Such fibers may be obtained from mechanical pulp (also known as groundwood), thermomechancial pulp (TMP), chemi-thermomechanical pulp (CTMP), and bleached-chemi-thermomechanical pulp (BCTMP).

The three principal pulping processes used in the paper industry are mechanical, chemical and semi-chemical. The most common wood pulp used, in particular, for bleached paper and paperboard products, is that generally referred to as chemical pulp and is well known to those skilled in the papermaking art. This pulp consists essentially of delignified, relatively long, flexible fibers. Specific examples of these pulps are produced by the well know kraft and sulfite processes. Unfortunately, these processes yield only about 50% of the input wood as pulp, but remove over 95% of the lignin. It is desirable to remove the lignin because lignin interferes with fiber bonding and results in pulp with low strength, brightness and color stability, all of which are desirable features of bleached paper and paperboard products. Meanwhile, mechanical pulp (which is sometimes referred to as groundwood), provides yields of more than 90% of the input wood, while removing little if any of the lignin content. An improvement in mechanical pulping know as thermomechanical pulping, or the pressure refining of wood, is characterized by the relative freedom from damage of the individual fibers (as occurs with conventional mechanical pulping), and reduced lignin content, while still giving yields of 90% or more. The product so produced is referred to as TMP. Lastly, TMP pulp can also be made from wood chips which have been pretreated (soaked) in mild chemical solutions, to produce chemi-thermomechanical pulp (CTMP), which, when bleached, is known as bleached-chemi-thermomechanical pulp (BCTMP). In each instance, the yield is somewhat reduced, but the lignin content is also reduced making such pulps more readily adaptable to the manufacture of bleached paper products. In accordance with the present invention such pulps have been found to be useful as authentication means when added to conventional chemical pulps.

It is, therefore, an object of the present invention to provide an easily authenticatable paper or paperboard product which is easy to manufacture and use.

It is another object of the present invention to provide an authenticable paper or paperboard product that can be used for labels or packaging of goods that are subject to counterfeiting.

Other objects and advantages of the present invention will become apparent from the following detailed description which sets forth several specific embodiments of the invention for the purpose of illustrating suitable modes for practicing the invention.

DETAILED DESCRIPTION

In accordance with the present invention, low concentrations of high lignin content fibers may be incorporated into a chemical paper furnish to produce a paper product which can be authenticated with a phloroglucinol stain. Upon spot testing, the high lignin content fibers produce a red or magenta color reaction. Examples of such high lignin content fibers are those obtained from groundwood, mechanical pulp, TMP, CTMP and BCTMP. The staining technique employs the use of a phloroglucinol stain prepared by dissolving 1 gram of phloroglucinol in a mixture of 50 ml methyl alcohol, 50 ml concentrated Hydrochloric acid, and 50 ml water. The authentication test can be successfully conducted on either coated or uncoated paper products since the hydrochloric acid in the stain solution easily destroys any calcium carbonate in the applied coatings. Where the coating does not contain calcium carbonate, the stained fibers in the wet state still show up through the coating. For the user willing to run a destructive test to determine authenticity of a paper label or paperboard pack age, the present invention offers a simple low cost approach that would fully comply with the FDA regulations regarding packaging including food packaging. In an initial study, an experiment was conducted to determine the percent of lignin content and corresponding color reaction to a phloroglucinol stain for several different high lignin content pulps. The results are shown in Table 1.

TABLE 1

| Sheet Composition (pulp type) | Lignin (%) | Color Reaction (Subjective) |
|---|---|---|
| Groundwood | 28–30 | 1 |
| Hardwood CTMP | 18–23 | 2 |
| 70% Aspen/30% Spruce CTMP | 18/29 | 3 |
| 100% Aspen CTMP | 18 | 4 |

Color Reaction - Ranked from most (1) to least (4) intense

EXAMPLE I

A 70% Aspen-30% Spruce bleached chemi-thermomechanical pulp manufactured by the Slave Lake Pulp Corporation was incorporated in a bleached Kraft paperboard furnish at concentrations ranging between 0.5 and 4.0%. Handsheets were made at a basis weight of 140 lbs/ream (ream size 3000 sq. ft.). When stained with the phloroglucinol solution, discrete red fibers were readily detectable at the 1.0% concentration. There were some fibers detectable at an addition level of 0.5% addition, but the numbers were too low to assure a positive test result. At higher concentrations, the surface of the sheet stained a uniform red color which is indicative of commercial papers containing high lignin content fibers. For effective use as a security feature, low levels of addition are preferred.

EXAMPLE II

In another experiment, a TMP pulp having a lignin content of about 28% was added to a standard 85% hardwood, 15% softwood bleached chemical papermaking furnish at concentrations of about 0.125 or 0.25%. Handsheets were prepared, and when spot tested with phloroglucinol stain, individual TMP fibers were easily discernable when they turned red. It will be noted that lower levels of addition were used in this Example as compared with the previous Example since the furnish in this Example was a 100% softwood refiner TMP pulp which produced a more intense red coloration on each of the lignin-rich fibers.

EXAMPLE III

In order to determine the effectiveness of the staining technique on coated paper products, the same TMP pulp used in the previous example was incorporated into a standard chemical bleached papermaking furnish at concentrations of 2.0 or 4.0 lbs/ton. Handsheets were formed and a typical coating formulation containing clay and calcium carbonate was applied to the handsheets at a coat weight of about 9.0 lbs #/ream (ream size 3300 sq. ft.). The sheets were machine calendered two nips at 300 pli before coating, and supercalendered four nips at 500 pli after coating. Spots tests on the coated side of the handsheets with the phloroglucinol stain showed that the TMP fibers turned red in less than 30 seconds.

Accordingly, it may be seen that an authenticatable paper product can be produced, the novelty of which involves the use of only a small amount of an otherwise conventional papermaking material in a bleached paper or paperboard product. Thus, once given the above disclosure, many other features, modifications or improvements will become apparent to the skilled artisan. Such features, modifications or improvements are, therefore, considered to be a part of this invention, the scope of which is to be determined by the following claims.

What is claimed is:

1. A method for authenticating a bleached chemical security paper comprising:

(a) adding to a bleached chemical papermaking furnish from about 0.125–4.0% by weight of high lignin content fibers selected from the group consisting of groundwood, mechanical, thermomechanical (TMP), chemi-thermomechanical (CTMP) and bleached-chemi-thermomechanical (BCTMP);

(b) converting the furnish of step (a) into paper; and, (c) applying to the paper a chemical agent to detect the presence of the high lignin content fibers.

2. The method of claim 1 wherein the chemical agent is phloroglucinol stain which causes the high lignin content fibers to turn red.

3. Bleached Chemical Security paper subject to being authenticated with an authenticating solution comprising paper prepared from a bleached, chemical pulp containing from about 0.125–4.0% by weight of high lignin content fibers selected from the group consisting of groundwood, mechanical, thermomechanical (TMP), chemi-thermomechanical (CTMP) and bleached-chemi-thermomechanical (BCTMP), wherein upon application of the authenticating solution to the paper, the high lignin content fibers become visible.

* * * * *